US005852299A

United States Patent [19]

Kimura et al.

[11] Patent Number: 5,852,299

[45] Date of Patent: Dec. 22, 1998

[54] IRREGULAR FEEDING DETECTION DEVICE FOR PRINTING MACHINE AND A DETECTION METHOD OF IRREGULAR FEEDING FOR PRINTING MACHINE

[75] Inventors: Takashi Kimura; Hideki Dohmoto, both of Fuchu, Japan

[73] Assignee: Ryobi Ltd., Hiroshima-ken, Japan

[21] Appl. No.: 897,841

[22] Filed: Jul. 21, 1997

Related U.S. Application Data

[63] Continuation of Ser. No. 637,617, Apr. 25, 1996, abandoned.

[30] Foreign Application Priority Data

Apr. 26, 1995 [JP] Japan ..... 7-101951

[51] Int. Cl.[6] ..... G01N 21/86

[52] U.S. Cl. ..... 250/559.4; 250/223 R; 226/4

[58] Field of Search ..... 250/559.4, 555.45, 250/559.46, 223 R; 356/239, 237, 430; 226/416, 45; 271/9.07, 9.02, 3.06, 3.09, 3.15

[56] References Cited

U.S. PATENT DOCUMENTS 4,474,454 10/1984 Sugiura ..... 399/21
4,790,524 12/1988 Murakami et al. ..... 271/9.09

FOREIGN PATENT DOCUMENTS 37 30 683 A1 3/1989 Germany .
40 01 120 C2 7/1991 Germany .
62-027263 2/1987 Japan .
63-267638 11/1988 Japan .
1-17979 4/1989 Japan .
01-134588 5/1989 Japan .
01-285547 11/1989 Japan .

*Primary Examiner*—Que T. Le
*Attorney, Agent, or Firm*—Merchant, Gould, Smith, Edell, Welter & Schmidt

[57] ABSTRACT

It is an object of the present invention to provide an irregular feeding detection device and a detection method of irregular feeding having high detection precision.

The irregular feeding detection device is a device to detect irregular feeding of printing paper 10 (the printing papers overlapped partially or overlapped completely) fed to a direction shown as arrow 90 in a printing machine. An transparent light amount detector 2*b* carries out a plurality of detection with predetermined interval when the printing paper 10 reaches to the predetermined starting position (FIG. 5A). Thus, the amount (value) of detecting light at a plurality of the detecting places (P1, P2 and P3) can be detected. For instance, when at least two pieces of printing papers are fed into the device, irregular feeding signal are outputted since the irregularity of feeding is detected at least two detecting places. It is possible to provide a plurality of transparent light amount detectors for detecting irregular state at a plurality of detecting places.

11 Claims, 11 Drawing Sheets

〈THE SECOND EMBODIMENT〉

3a, 4a, 5a : LIGHT EMITTING PART
3b, 4b, 5b : TRANSPARENT LIGHT AMOUNT DETECTOR

〈THE FIRST EMBODIMENT〉

2a : LIGHT EMITTING PART
2b : TRANSPARENT LIGHT AMOUNT DETECTOR
10 : PRINTING PAPER
29 : TIMING DETECTOR

〈THE FIRST EMBODIMENT〉

(THE SECOND EMBODIMENT)

3a, 4a, 5a : LIGHT EMITTING PART
3b, 4b, 5b : TRANSPARENT LIGHT AMOUNT DETECTOR

〈THE THIRD EMBODIMENT〉

6a : LIGHT EMITTING PART
6b : LINE SENSOR
7a : LIGHT EMITTING PART
7b : TRANSPARENT LIGHT AMOUNT DETECTOR

IRREGULAR FEEDING DETECTION DEVICE FOR PRINTING MACHINE AND A DETECTION METHOD OF IRREGULAR FEEDING FOR PRINTING MACHINE

This is a Continuation of application Ser. No. 08/637,617, filed 25 Apr. 1996, now abandoned.

BACKGROUND OF INVENTION

1. Field of the Invention

This invention relates to an irregular feeding detection device for printing machine and a detection method of irregular feeding for printing machine, especially a detection device and a detection method which is able to prevent erroneous operation with high detection precision.

2. Description of the Prior Art

A technique for detecting irregular feeding in a printing machine is disclosed for instance in the Japanese patent publication No. Hei 1-17979. FIG. 1 shows a mechanism of a printing machine which has an irregular feeding detection device. Accumulated printing papers 10 on a table (not shown) are sucked with a suction foot 30 one after another from the uppermost one. Then the sucked printing paper 10 is inserted between a feeding roller 80 and 81. The inserted printing paper 10 is sent onto a feeder table 85 in accordance with a rotation of the feeding roller 80 and 81. The printing paper 10 is fed toward a direction shown as arrow 90 on the feeder table 85, and is supplied to a paper feed drum 28 after touching a front lay section 84.

In a feeding of the printing paper, there is a case that a plurality of the printing papers 10 are sucked with the suction foot under overlapped condition by influence of electrostatic, and the printing papers are fed onto the feeding table 85. If such an irregular feeding (a condition that the printing papers are fed under overlapped each other) is occurred, it causes misprinting or other failures in a printing process. So that, it is necessary to take the overlapped papers (printing papers fed irregularly) out from the printing machine by detecting them with the irregular feeding detection device, while an operation of the printing machine is suspended. In order to detect the irregular feeding, an irregular feeding detector 82 is provided in vicinity of the front lay section 84 as shown in FIG. 1. The irregular feeding detector 82 comprises a light emitting part 82*a* and a light sensitive part 82*b*, and the printing paper is guided into therebetween. The light emitting part 82*a* emits detecting light to the printing paper 10 and the detecting light therethrough is received by the light sensitive part 82*b*.

When a plurality of the printing papers under overlapped condition are fed between the light emitting part 82*s* and the light sensitive part 82*b*, amount (value) of transparent light is decreased. Thus, the operation of the printing machine is suspended as a result of detection whether the overlapped printing papers are guided therebetween or not in accordance with the value of transparent light received by the light sensitive part 82*b*.

Here, the value of the light pass through a piece of the printing paper 10 depends upon thickness and quality of the printing paper. So that, at first, a piece of the printing paper 10 utilized in a printing process (hereinafter referred to as a reference paper) is guided between the light emitting part 82*a* and the light sensitive part 82*b*. Then, detection is carried out by comparing the value of transparent light pass through the reference paper (reference light amount) with the value of transparent light of every guided printing paper. Also, the irregular feeding detector 82 detects irregularity of feeding at a detecting place P8 locates on the foremost part of the printing paper as shown in FIG. 2A. For instance, when multi-color printing is carried out, there is a case that a printing paper 10 which has been printed the first color is guided between the light emitting part 82*a* and the light sensitive part 82*b*. In that case, if the irregular feeding detector carries out detection at a printed region 10R of the printing paper 10, there is a probability to cause an erroneous detection by influence printing ink of the first color printed on the printing paper. To avoid erroneous detection, a detection is carried out by detecting the value of transparent light at the detecting place P8 where locates at out of the printed region 10R. In the convectional irregular feeding detection device, the detecting light is emitted from the light emitting part 82*a* by predetermined timing which is synchronized with a rotation of the paper feed drum 28.

However, conventional detection of irregular feeding has following problems to resolve. The irregular feeding detector 82 detects irregularity of feeding for the printing paper at the detecting places P8 (see FIG. 2 A) located on the foremost part of the printing paper 10. So that, it is not possible to detect irregularity of feeding for the printing papers when the printing papers slipped each other and being overlapped in two pieces (see FIG. 2B).

To resolve such a problem, it is considered to detect irregularity of feeding for the printing paper at a detecting place P9 within the printed region where locates near the center of the printing paper 10 as shown in FIG. 2C. In some cases, the printed region 10R has already been printed in previous processes. So that, if location of the printing papers 10 is slipped each other slightly when detecting the reference light value, it is not possible to detect irregularity of feeding for the printing paper properly.

For instance, it is assumed that detection of irregularity of feeding for the printing paper 10 sequentially fed to the direction shown as arrow 90 is carried out by utilizing the value of transparent light for singular printing paper being used initially as a reference light value detected at the detecting place P9 shown in FIG. 2C. In this case, when the printing paper 10 is fed onto the feeder table 85 at a timing delays it should be, a printed part 10K of the printing paper 10 is detected by the irregular feeding detector 82. Under the circumstances, the value of transparent light is decreased by influence of the printed part 10K and the operation is detected as irregular feeding.

The printing paper 10 can not be inserted between the feeding roller 80 and 81 by the suction foot 30 smoothly, especially when the foremost part of the printing paper is in curling. So that, feeding of the printing paper 10 onto the feeder table 85 delays slightly. In that case, there is a probability to detect the printed part 10K by the irregular feeding detector 82.

OBJECT AND SUMMARY OF THE INVENTION

The purpose of the present invention is to provide an irregular feeding detection device and a detection method of irregular feeding with high detection precision.

In accordance with characteristics of the present invention, an irregular feeding detection device for printing machine for detecting irregular feeding of printing papers fed at least two pieces under overlapped condition in basis of amount of transparent light which is emitted from a light source and through a printing paper fed to the printing machine comprises:

a starting position detector for detecting arrival of the printing paper at a starting position, a transparent light amount detector for detecting the amount of transparent light of the printing paper detected at least two different detecting places, the different detecting places are determined by the starting position, and wherein the different detecting places are radiated by the light from the light source, a reference light amount storing part for storing the amount of transparent light detected at the different detecting places of a piece of the printing paper as a reference light amount for each of the different detecting places, and a judging part for outputting irregular feeding detection signal when the amount of transparent light detected at each of the detecting places being less than the reference light amount of corresponding detecting places.

Also, in accordance with characteristics of the present invention, a detection method of irregular feeding for printing machine for detecting irregular feeding of printing papers fed at least two pieces under overlapped condition in basis of amount of transparent light which is emitted from a light source and through a printing paper fed to the printing machine comprises steps of:

step for storing the amount of transparent light detected at least two different detecting places of a piece of the printing paper as a reference light amount for each of the different detecting places, step for detecting arrival of the printing paper at a staring position, step for determining the different detecting places of the printing paper by the starting position, step for radiating the light from the light source to the different detecting places of the printing paper, step for detecting the amount of transparent light at the different detecting places of the printing paper, step for outputting irregular feeding detecting signal when the amount of transparent light detected at each of the different detecting places being less than the reference light amount of corresponding detecting places.

While the novel features of the invention are set forth in a general fashion, both as to organization and content, it will be better understood and appreciated, along with other objections and features thereof, from the following detailed description taken in conjunction with the drawings.

DETAILED DESCRIPTION OF THE PREFERRED EMBODIMENT

[Basic structure of the present invention]

Figure 1:
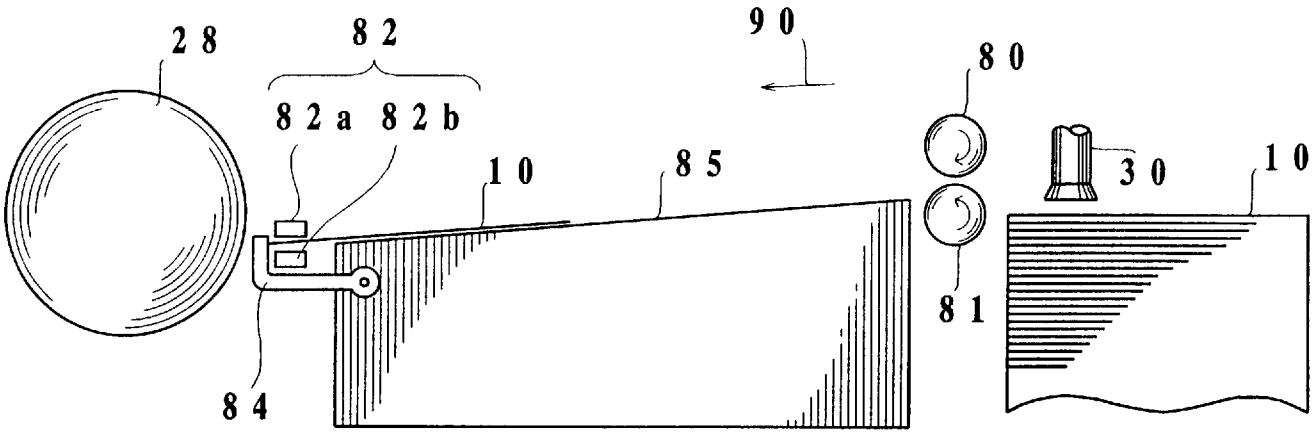
FIG. 1 (prior art)
FIG. 1 is an overall view illustrating a structure of an irregular feeding detection device for printing machine in the prior art.
Figure 2A:
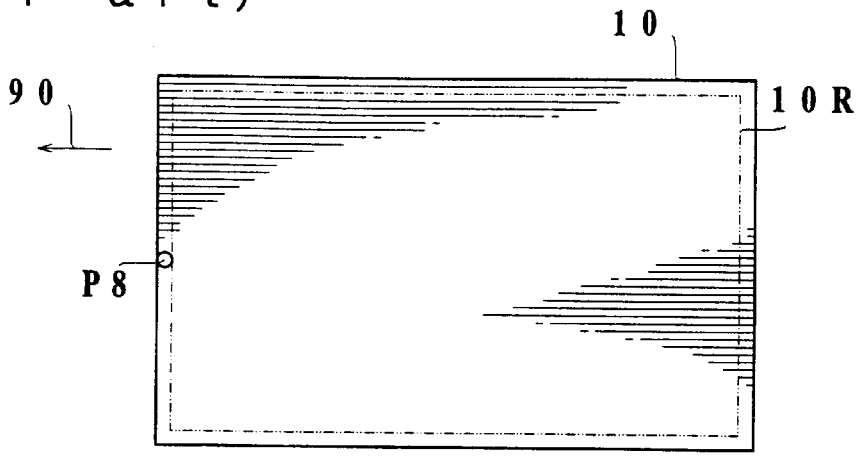
FIG. 2A (prior art)
FIG. 2A, FIG. 2B and FIG. 2C are views illustrating a relationship of position between a printing paper and detecting places in the irregular feeding detection device for printing machine in the prior art.
Figure 2B:
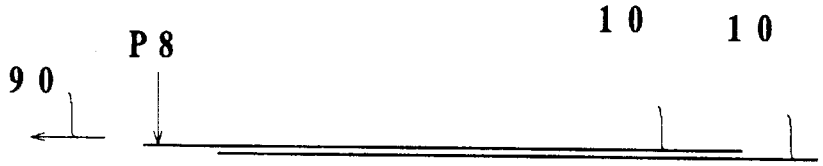
FIG. 2B (prior art)
Figure 2C:
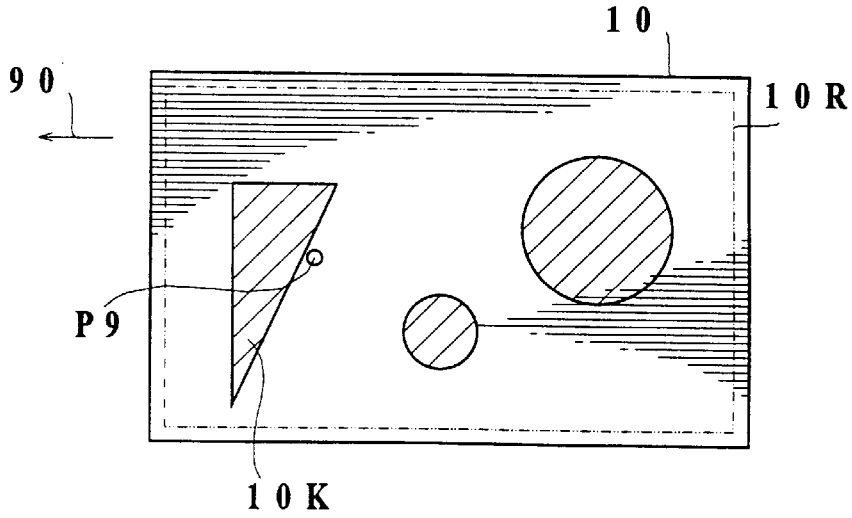
FIG. 2C (prior art)
Figure 3:
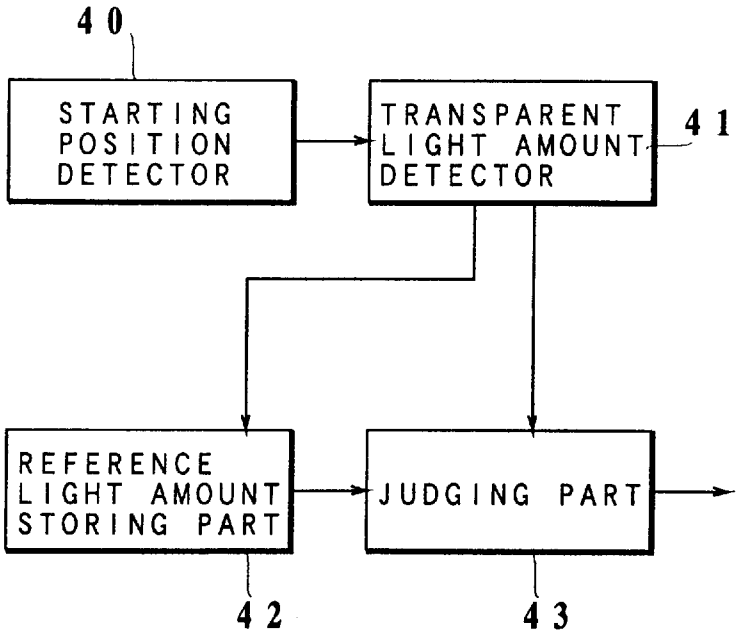
FIG. 3 is a basic block diagram of an irregular feeding detection device for printing machine and a method thereof in the present invention.

FIG. 3 shows a basic block diagram of an irregular feeding detection device for printing machine and a method thereof in the present invention. The irregular feeding detection device is a device for detecting irregular feeding (a condition that the printing papers are fed under overlapped each other) in a printing machine when such overlapped printing papers are fed into the printing machine.

The irregular feeding detection device in present invention comprises a starting position detector 40, a transparent light amount detector 41, a reference light amount (value) storing part 42 and a judging part 43 as shown in FIG. 3. The starting position detector 40 detects arrival of the printing paper to a starting position (predetermined position). Thereafter, detection is carried out at least two different detecting places utilizing the starting position as a reference position by the transparent light amount detector 41. Light from a light source is radiated to the detecting places of the printing paper, and the transparent light amount detector 41 detects the amount of transparent light at each of the detecting places.

To make a criteria for judging whether feeding of the printing paper is irregular or not, at first, a piece of printing paper is sent into the printing machine, and the amount (values) of transparent light at each of the detecting places are stored into the reference light value storing part 42 as reference light values. The values of transparent light detected at each of the detecting places of the printing paper sequentially fed are detected.

Then the judging part 43 takes in both of the reference light values stored in the reference light value storing part 42 and the values of transparent light detected at each of the detecting places for the fed printing paper. Irregular feeding detection signal is outputted when the values of transparent light at the detecting places are less than the reference light values such as in an irregular state. The judgement is carried out by comparing the values of the transparent light with the reference light values. The printing machine stops its operation in accordance with the irregular feeding detection signal and then an operator of the printing machine take the overlapped papers out from the printing machine.

[The first embodiment]

Figure 4:
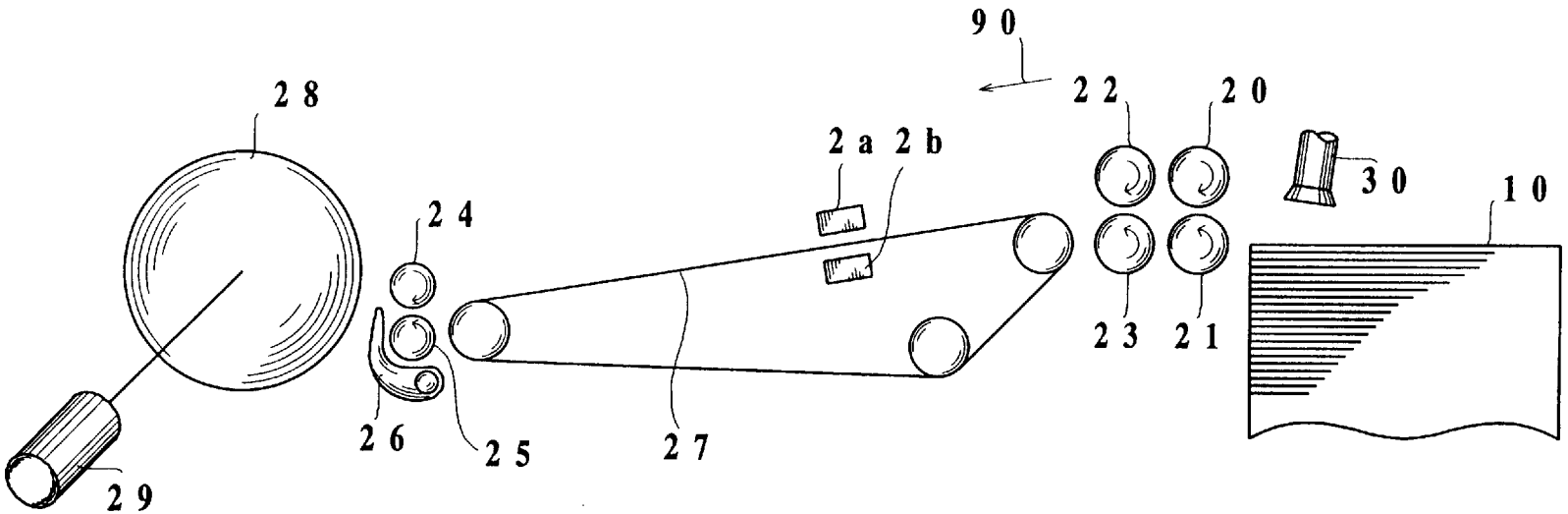
FIG. 4 is an overall view illustrating the first embodiment of the irregular feeding detection device for printing machine and the method thereof in the present invention.

FIG. 4 shows an overall view illustrating the first embodiment of an irregular feeding detection device for printing machine and the method thereof in the present invention. The printing papers 10 accumulated on a table (not shown) are sucked with a suction foot 30 one after another from the uppermost one. Then the sucked printing paper 10 is inserted between a feeding roller 20, 21, 22 and 23. The inserted printing paper 10 is sent onto a feeding belt 27 in accordance with a rotation of the feeding roller 20, 21, 22 and 23. The printing paper 10 is fed toward a direction shown as arrow 90 by feeding of the feeding belt 27, and that is inserted between a feeding roller 24 and 25, then the printing paper 10 is supplied to a paper feed drum 28 after it touches to a front lay section 26. In order to detect irregular feeding (a condition that the printing papers are fed under overlapped each other), the transparent light amount detector 2*b* is provided in the present invention. A light emitting part 2*a* as the light source is located at upper side of the transparent light amount detector 2*b*, and the printing paper 10 passes through therebetween. The transparent light amount detector 2*b* varies values of transparent light (voltage value) in accordance with the values of transparent light. The values of transparent light outputted by the transparent light amount detector 2*b* is decreased when a plurality of the printing papers overlapped each other are guided therebetween. The judging part 43 judges whether feeding of the printing paper is in the irregular state or not in accordance with decrease of the amount of transparent light.

Figure 6:
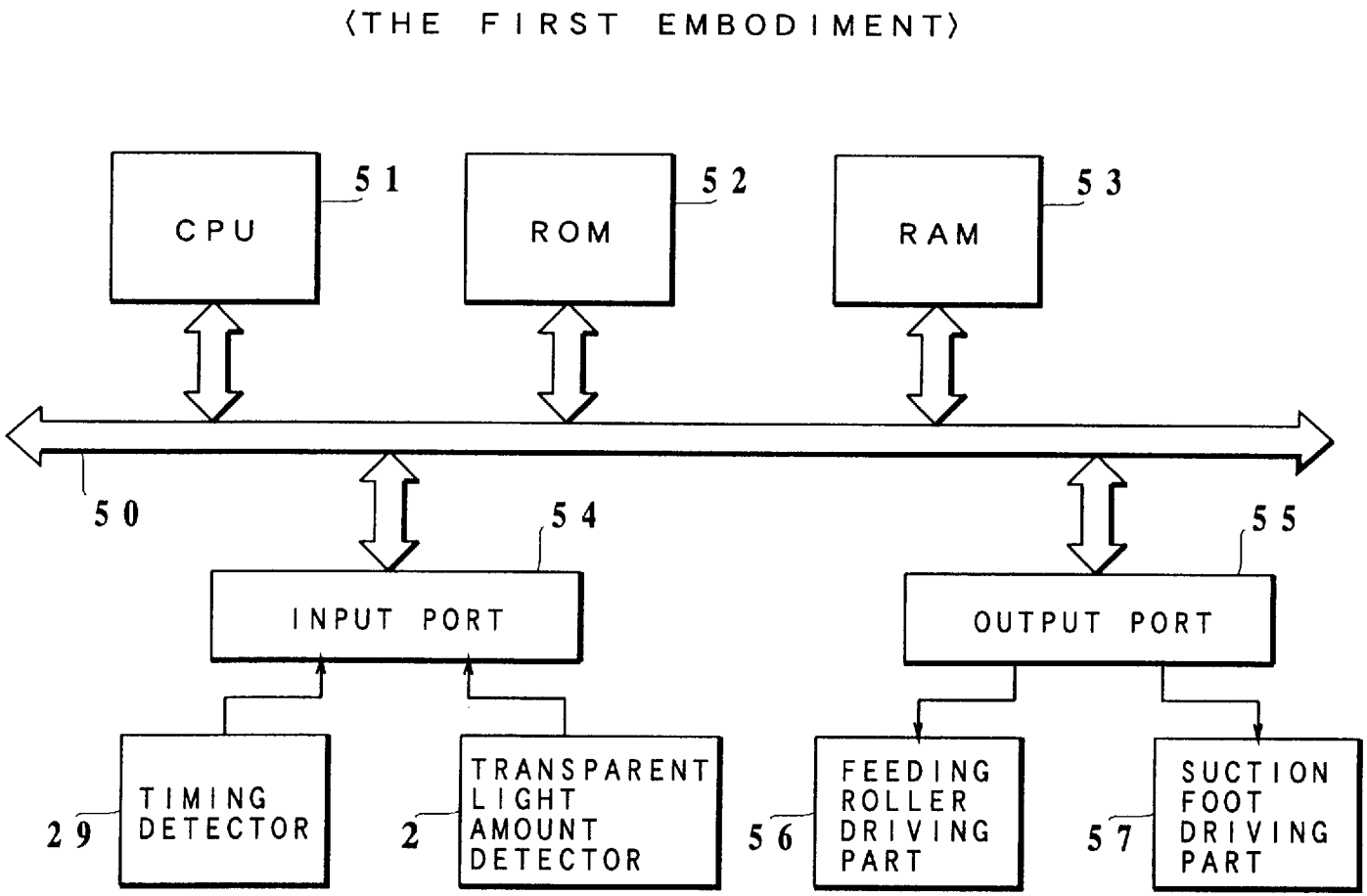
FIG. 6 is a block diagram of a hardware logic of the first embodiment of the irregular feeding detection device for printing machine and the method thereof in the present invention.

FIG. 6 shows a block diagram of a hardware logic of the irregular feeding detection device and the method thereof in this embodiment. A CPU 51, a ROM 52 and a RAM 53 are connected to a bus-line 50 as shown in FIG. 6. The CPU 51 controls other parts in accordance with computer programs stored in the ROM 52. A timing detector 29 and an transparent light amount detector 2*b* are connected to the bus-line 50 through an input port 54. The timing detector 29 generates the predetermined number of pulses while the paper feed drum 28 rotates once as shown in FIG. 4. Further, a feeding roller driving part 56 and a suction foot driving part 57 are connected to the bus-line 50 through an output port 55.

FIG. 5 shows a relationship of position between the printing paper 10 and the transparent light amount detector 2. The printing paper 10 is fed toward the direction shown as arrow 90 with the feeding belt 27, so that the fed printing paper 10 interrupts the light emitted from the light emitting part 2*a* (FIG. 5A). The CPU 51 detects interruption of the detecting light through the input port 54, and the CPU 51 recognizes the position where detecting a foremost part 10H of the printing paper as the starting position shown in FIG. 5A. In other words, a singular of the transparent light amount detector 2*b* is provided, and the transparent light amount detector 2*b* is further utilized as the starting position detector as well as it is.

Figure 5A:
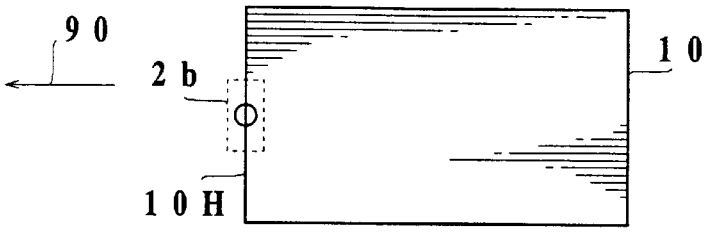
FIGS. 5A, 5B, 5C, 5D, and FIG. 5E are views illustrating relationship of positions between a printing paper and a transparent light amount detector in the first embodiment of the irregular feeding detection device for printing machine and the method thereof in the present invention.

Upon reaching the printing paper 10 to the position shown in FIG. 5A, detection is carried out in plural times with the predetermined interval by the transparent light amount detector 2*b*. It is possible to detect at least two different detecting places in a direction of feeding (a direction shown as arrow 90) by carrying out detection in plural times with certain interval, since the printing paper 10 is fed toward the direction shown as arrow 90.

Figure 5B:
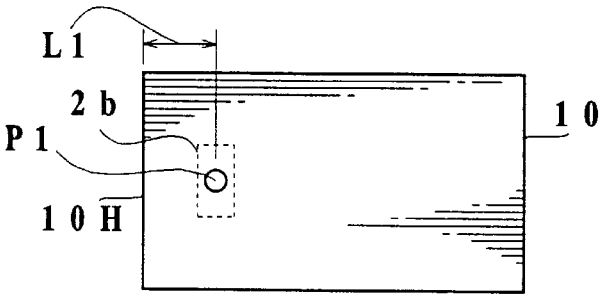
Figure 5C:
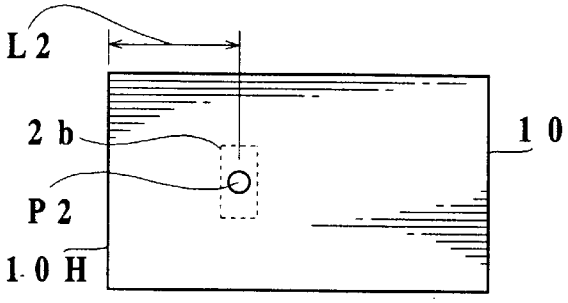
Figure 5D:
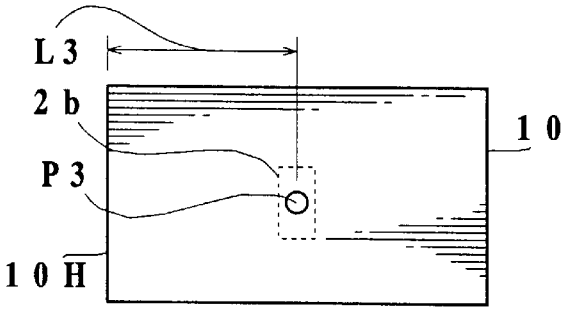

In this embodiment, detection at the three detecting places such as the first detecting place P1, the second detecting place P2 and the third detecting place P3 is carried out by detecting these three places as shown in FIG. 5B, 5C and 5D. The timing for carrying out these three detections is determined by counting the pulses generated by the timing detector 29. So that, it is possible to detect the value of transparent light at the first detecting place P1, the second detecting place P2 and the third detecting place P3 accurately as well as avoiding influence of the rotation of the paper feed drum 28.

The CPU 51 counts the number of pulses generated by the timing detector 29 from when the printing paper 10 reach to the starting position shown in FIG. 5A. Then the CPU 51 carries out the first detection by taking the value of transparent light outputted from the transparent light amount detector 2*b* when the number of pulses reach to the first predetermined number. The printing paper 10 is fed toward the direction shown as arrow 90 for a length L1 while passing a certain period of time correspond to the first predetermined number as shown in FIG. 5B. Therefore, it is possible to detect the transparent light at the first detecting place P1 when the number of pulses reach to the first predetermined number.

Also, the printing paper 10 is fed toward the direction shown as arrow 90 for a length L2 when the number of pulses reach to the second predetermined number as shown in FIG. 5C. So that, it is possible to detect transparent light at the second detecting place P2 as a result of taking the value of transparent light outputted from the transparent light amount detector 2*b*.

Moreover, the printing paper 10 is fed toward the direction shown as arrow 90 for a length L3 when the number of pulses reach to the third predetermined number as shown in FIG. 5D. So that, it is possible to detect transparent light at the third detecting place P3 if the value of transparent light outputted from the transparent light amount detector 2*b* is taken when the number of pulses reach to the third predetermined number.

To make a criteria for judging whether feeding of the printing paper is irregular or not, at first, a piece of printing paper 10 utilized in a printing process hereinafter referred to as a reference paper) is fed onto the feeding belt 27, and values of transparent light at each of the detecting places such as the first detecting place P1, the second detecting place P2 and the third detecting place P3 are detected. Thereafter, the detected values are stored as the first reference value, the second reference value and the third reference value respectively. Judgement of irregular feeding is carried out by comparing the values of transparent light detected at each of the detecting places of the printing paper fed sequentially with the reference values.

Thus, judgement of irregular feeding is carried out by comparing the value of transparent light with the reference value of a piece of reference printing paper 10. For instance, when multi-color printing is carried out, there is a case that a printing paper 10 which has been printed the first color is guided between the light emitting part 2*a* and the transparent light amount detector 2*b*. Even when the printing paper already printed is guided therebetween, an erroneous detection caused by influence of the printing ink never occurs if any of the light sensitive parts detect the printed region of the printing paper 10.

Figure 7:
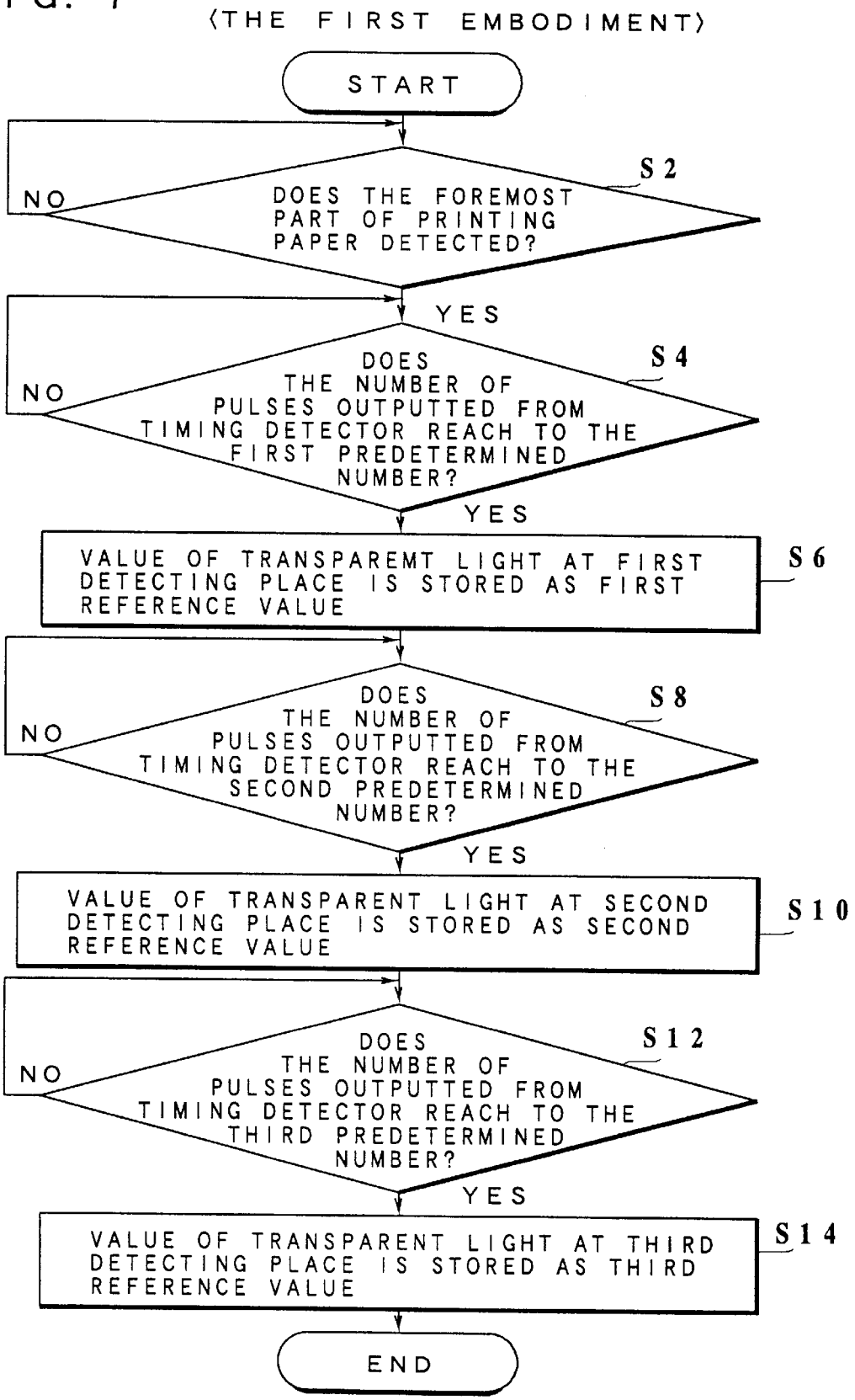
FIG. 7 is a flow chart of computer programs stored in ROM shown in FIG. 6.
Figure 8:
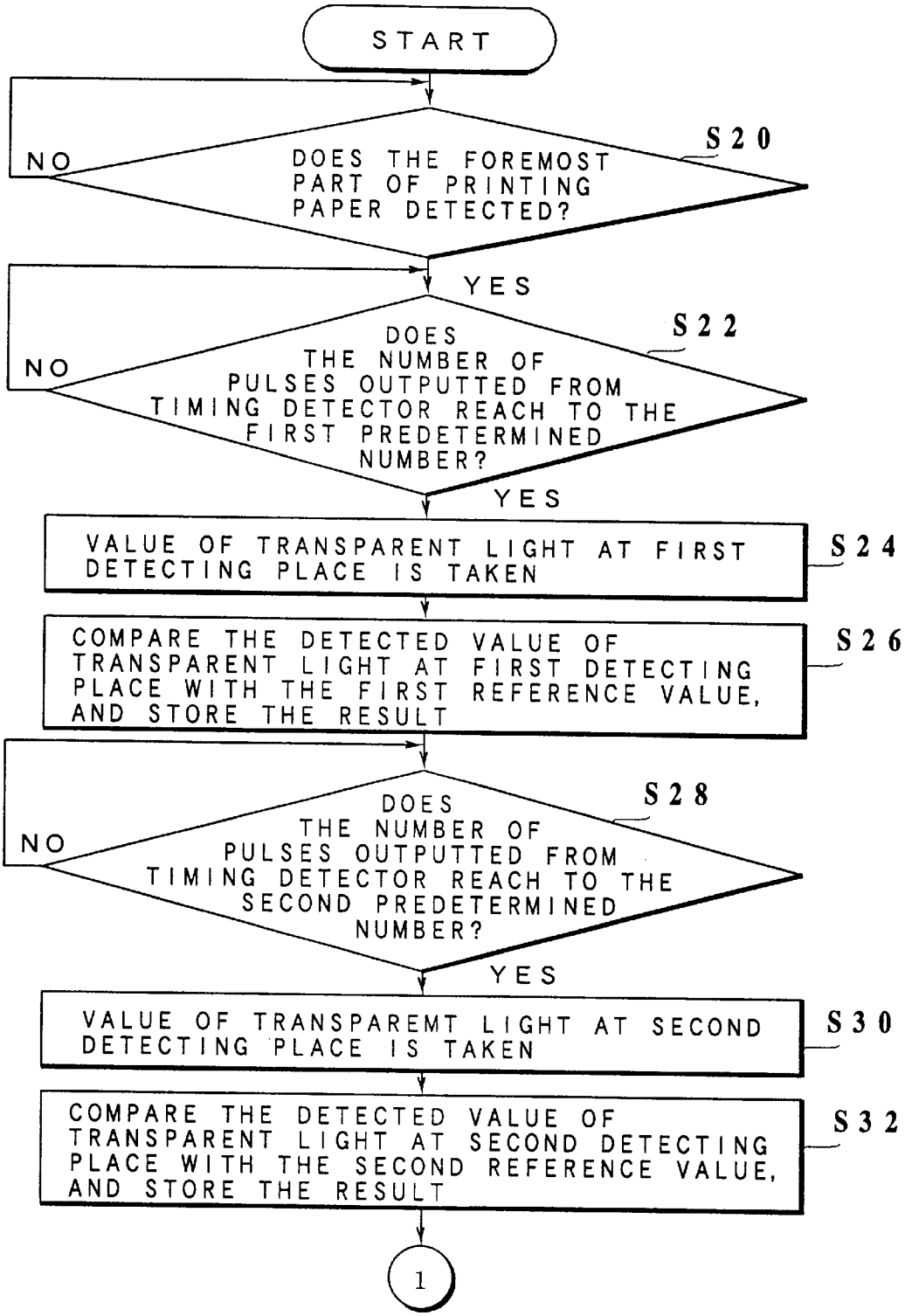
FIG. 8 is a flow chart of the computer program stored in ROM shown in FIG. 6.
Figure 9:
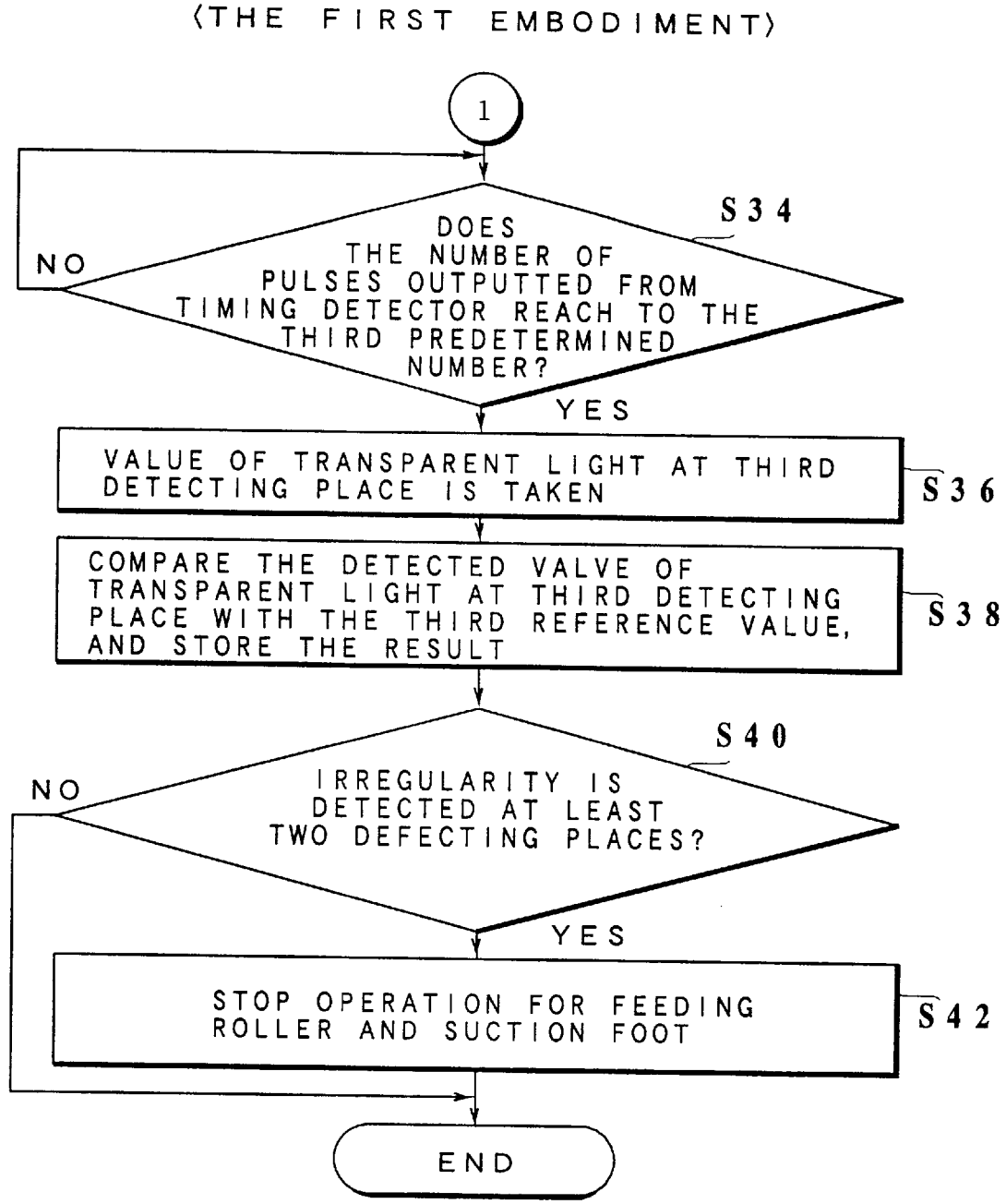
FIG. 9 is a flow chart of the computer program stored in ROM shown in FIG. 6.

FIG. 7, FIG. 8 and FIG. 9 show flow charts of the computer programs stored in the ROM 52 shown in FIG. 6. FIG. 7 is a flow chart for describing steps to set up values of transparent light of a reference printing paper 10 at each of the detecting places as a reference light value. A detail description of steps for setting the value of transparent light as the reference light value will be given in accordance with FIG. 7.

At first, the reference printing paper 10 is fed onto the feeding belt 27, and judgement is carried out whether or not the foremost part 10H of the printing paper 10 is detected by the transparent light amount detector 2*b* (step S2). When the printing paper 10 is reached to the above-mentioned position (the starting position) as shown in FIG. 5A, the CPU 51 obtains the pulses outputted from the timing detector 29 through the input port 54 and start counting the obtained pulse and the CPU 51 judges whether or not the number of pulses reach to the first predetermined number (hereinafter referred to as the first pulse number) (step S4). Then, the value of transparent light of the transparent light amount detector 2*b* is obtained when the number of pulse is reached to the first pulse number, and the value of transparent light at the first detecting place P1 is stored into the RAM 53 as a first reference value (step S6).

Consecutively, the CPU 51 judges whether or not the pulses outputted from the timing detector 29 reach to the second predetermined number (hereinafter referred to as the second pulse number) (step S8). Then, the value of transparent light of the transparent light amount detector 2*b* is obtained when the number of pulse is reached to the second pulse number, and the value of transparent light at the second detecting place P2 (FIG. 5C) is stored into the RAM 53 as a second reference value (step S10). Thereafter, the CPU 51 judges whether or not the number of pulses outputted from the timing detector 29 reach to the third predetermined number (step S12). Also, the value of transparent light of the transparent light amount detector 2*b* is obtained when the number of pulse is reached to the third pulse number, and the value of transparent light at the third detecting place P3 (FIG. 5D) is stored into the RAM 53 as a third reference value (step S14).

The values of transparent light of the reference printing paper 10 at each of the detecting places are stored, and are set as the first reference value, the second reference value and the third reference value respectively by carrying out the above-mentioned steps. Judgement of irregular feeding is carried out to all the printing paper 10 fed sequentially by comparing actual detected value at each of the detected places with each of the reference values stored by the computer programs shown in FIG. 7.

Details for judgement of irregular feeding will be described by utilizing flow charts shown in FIG. 8 and FIG. 9. At first, the CPU 51 judges whether or not the printing paper 10 reaches to the starting position shown in FIG. 5A (step S20). The CPU 51 obtains the pulses outputted from the timing detector 29 through the input port 54 and start counting the obtained pulses.

Then, the CPU 51 judges whether or not the number of obtained pulses reach to the first predetermined number (step S22). Since the printing paper 10 is fed to the direction shown as arrow 90 for the length L1 when the number of pulses reach to the first predetermined number as shown in FIG. 5B. So that, it is possible to detect transparent light at the first detecting place P1 as a result of taking the value of transparent light outputted from the transparent light amount detector 2*b* (step S24).

Further, detection for irregularity of feeding is carried out by comparing the value of transparent light detected at the first detecting place P1 with the first reference value stored at the step S6 in FIG. 7 (step S26). When the value of transparent light at the detecting place P1 is less than the first reference value, it is judged that the fed printing papers are overlapped at least two pieces. So that, it is judged that feeding is in the irregular state. On the contrary, when the value of the detected transparent light is substantially the equivalent to the first reference value, it is judged that the fed paper is the reference printing paper.

Figure 5E:
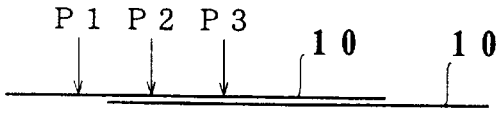

Now, it is assumed that two of the printing papers slipped each other are fed into the printing machine as shown in FIG. 5E. In that case, because of the printing paper 10 fed at the first detecting place P1 is a singular, the value of transparent light at the detecting place P1 and the first reference value is almost equivalent. So that, it is judged that the fed paper detected at the detecting place P1 is the reference printing paper. Then, the result of the judgement is stored in the step S26.

Consecutively, the CPU 51 judges whether or not the number of pulses outputted from the timing detector 29 reach to the second pulse number (step S28). Since the printing paper 10 is fed toward the direction shown as arrow 90 for the length L2 when the number of pulses reach to the second predetermined number as shown in FIG. 5C. So that, it is possible to detect transparent light at the second detecting place P2 as a result of taking the value of transparent light outputted from the transparent light amount detector 2*b* (step S30).

Further, detection for irregularity of feeding is carried out by comparing the value detected at the second detecting place P2 and the second reference value stored at the step S10 in FIG. 7 (step S32). When the value of transparent light at the second detecting place P2 is less than the second reference value, it is judged that the fed printing papers are overlapped at least two pieces. So that, it is judged that feeding of the printing paper is in the irregular state. On the contrary, when the value of the detected transparent light is substantially equivalent to the second reference value, it is judged that the fed paper is a reference printing paper.

Since the printing papers 10 are overlapped each other at the second detecting place P2 as shown in FIG. 5E, the value of transparent light is less than the second reference value. So that, it is judged that feeding of the printing papers is in the irregular state. The result of the judgement is stored in the step S32.

Thereafter, the CPU 51 judges whether or not the number of pulses outputted from the timing detector 29 reach to the third pulse number (step S34). Since the printing paper 10 is fed to the direction shown as arrow 90 for the length L3 when the number of pulses reach to the third predetermined number as shown in FIG. 5D. So that, it is possible to detect transparent light at the third detecting place P3 as a result of taking the value of transparent light outputted from the transparent light amount detector 2*b* (step S36).

Further, detection for irregularity of feeding is carried out by comparing the value detected at the third detecting place P3 and the third reference value stored at the step S14 in FIG. 7 (step S38). When the value of transparent light at the third detecting place P3 is less than the third reference value, it is judged that the printing papers are overlapped at least two pieces. So that, it is judged that feeding of the printing paper is in the irregular state. On the contrary, when the value of the detected transparent light is substantially equivalent to the third reference value, it is judged that the fed paper is a reference printing paper.

Since the printing papers 10 are overlapped each other at the third detecting place P3 as detected at the second detecting place P2 shown in FIG. 5E, the value of transparent light is less than the third reference value. So that, it is judged that feeding of the printing papers is in the irregular state. The result of the judgement is stored in the step S38.

Thus, judgement is carried out whether feeding of the fed paper is in the irregular state or not at the first detecting place P1, the second detecting place P2 and the third detecting place P3, then it is proceeded to step S40. In the step S40, judgement is carried out whether irregularity of feeding is detected at least two detecting places or not. In this case, irregularity of feeding is detected at both the second detecting place P2 and the third detecting place P3, so that it is proceeded to step S42. Thereafter, signals are provided to the feeding roller driving part 56 and the suction foot driving part 57 by the CPU 51 through the output port 54 so as to stop the operation of the feeding roller 24, 25 and the suction foot 30 (step S42). The operator take the overlapped paper out from the printing machine when feeding of the printing paper is suspended, and then the operator continues the printing work.

When irregularity of feeding is detected at one detecting place or at none of detecting places in the step S40, feeding work of the printing paper is continued and the steps shown in FIG. 8 which start with the step S20 are carried out to the printing paper 10 which is fed sequentially.

Thus, in this embodiment, it is possible to detect irregularity of feeding for the printing papers accurately even when the printing papers slipped each other in overlapped condition as shown in FIG. 5E by detecting at least two different detecting places (the first detecting place P1, the second detecting place P2 and the third detecting place P3) in the direction of feeding. Also, it is possible to prevent erroneous detection caused by poor registration since irregular feeding detection signal is outputted when irregularity of feeding is detected at least two detecting places for stopping the operation of the feeding roller 24, 25 and the suction foot 30.

[The second embodiment]

Figure 10:
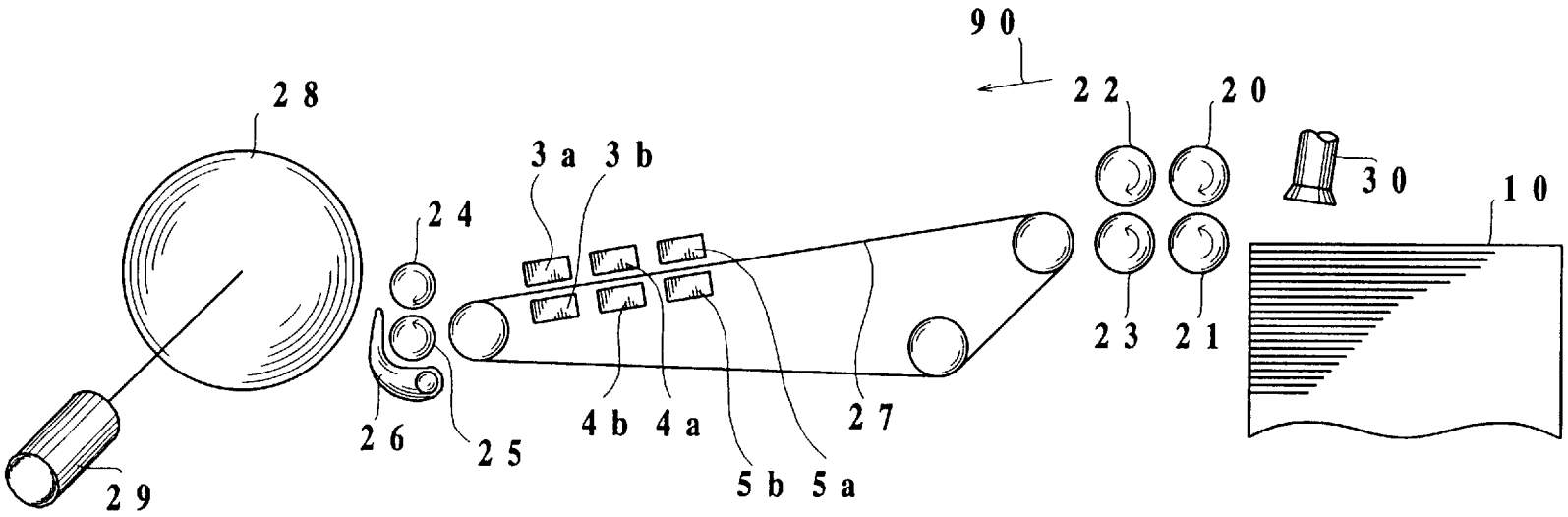
FIG. 10 is an overall view illustrating the second embodiment of the irregular feeding detection device for printing machine and the method thereof in the present invention.

FIG. 10 shows the second embodiment of the irregular feeding detection device and the method thereof in the present invention. In the first embodiment described above, a singular of the transparent light amount detector 2*b* is provided for detecting irregularity of feeding at least two detecting places by carrying out a plurality of detections with certain period of interval. On the other hand, in the present invention, a transparent light amount detector 3*b*, 4*b* and 5*b* are provided, and a light emitting part 3*a*, 4*a* and 5*a* as the light source are located upper side of the transparent light amount detector 3*b*, 4*b* and 5*b*. Irregularity of feeding for the printing paper is detected at the first detecting place P1, the second detecting place P2 and the third detecting place P3 by carrying out detection utilizing each of the transparent light amount detector 3*b*, 4*b* and 5*b*.

In this embodiment, detection is carried out at almost the same time by the transparent light amount detector 3*b*, 4*b* and 5*b* when the printing paper 10 is fed to the direction shown as arrow 90 and then it touches to the front lay section 26. It is possible to carry out detection for judging whether or not the printing paper 10 reaches to a predetermined detecting position (the starting position) by utilizing one of the transparent light amount detector 3*b*, 4*b* and 5*b*. In other words, one of the transparent light amount detectors is utilized as the starting position detector in this embodiment.

When irregularity of feeding for the printing paper is detected at least two detecting places after finishing the detection by the transparent light amount detector 3*b*, 4*b* and 5*b*, the CPU 51 judges that the printing papers 10 being fed are irregular ones, and the CPU 51 controls to stop the operation of the feeding roller 24, 25 and the suction foot 30. Other structure of the irregular feeding detection device is the same as the first embodiment described above.

[The third embodiment]

Figure 11:
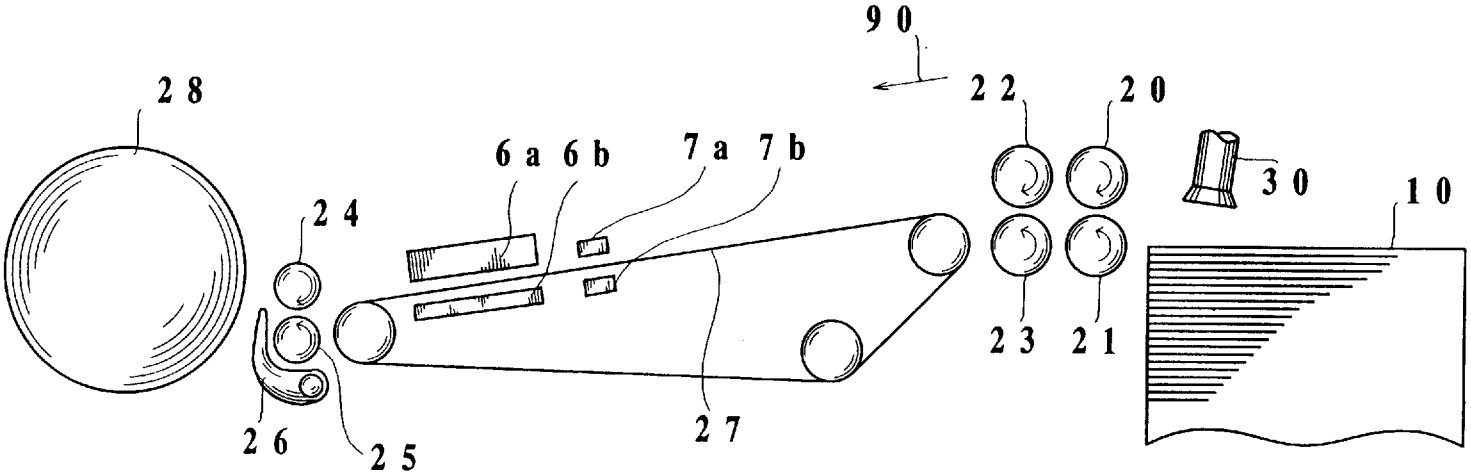
FIG. 11 is an overall view illustrating the third embodiment of the irregular feeding detection device for printing machine and the method thereof in the present invention.

FIG. 11 shows the third embodiment of an irregular feeding detection device and the method thereof in the present invention. In this embodiment, an emitting part 7*a* as the light source and a transparent light amount detector 7*b* is provided. Further, a light emitting part 6*a* and a line sensor 6*b* are provided toward a direction of feeding for the printing paper (a direction shown as arrow 90) in this embodiment.

In the present invention, the foremost position of the printing paper 10 is detected at the first detecting place P1, the second detecting place P2 and the third detecting place P3 by the line sensor 6*b*. In other words, the printing paper 10 interrupts the light emitted from the light emitting part 6*a* when the printing paper 10 is fed to the direction shown as arrow 90 on the feeding belt 27. Therefore, the foremost position of the printing paper 10 on the feeding belt 27 can be detected by judging which of light sensing elements arranged in a series on the line sensor 6*b* does not detect the transparent light due to interruption by the printing paper 10 out of a plurality of the light sensing elements.

In this embodiment, three of the predetermined light sensing elements within the light sensing elements arranged on the line sensor 6*b* are appointed, and detection for irregularity of feeding for the printing paper is carried out by the transparent light amount detector 7*b* when the light is interrupted at any of the light sensing elements. In other words, the value of transparent light for the printing paper 10 at the first detecting place P1, the second detecting place P2 and the third detecting place P3 can be detected.

When irregularity of feeding for the printing paper 10 is detected at least two detecting places, the operation of the feeding roller 24, 25 and the suction foot 30 is suspended as a result of irregular feeding for the printing papers 10. In this embodiment, it is not necessary to use the timing detector 29 described in the first embodiment and the second embodiment in the present invention. Because the timing of detection at the first detecting place P1, the second detecting place P2 and the third detecting place P3 is determined by the position detector 6. Other structure of the irregular feeding detection device is the same as the first embodiment described above.

OTHER EMBODIMENT IN THE PRESENT INVENTION

Although the transparent light amount detector also functions as the starting position detector in the first and the second embodiment, it is possible to detect the starting position by providing the starting position detector separately from the transparent light amount detector. The detection for irregularity of feeding is carried out at the three detecting place in the above embodiment, the detection can be carried out at two detecting places or at least four detecting places.

The structure of the irregular feeding detection device for printing machine in the present invention is not limited to above described structure. It is possible to employ another structure, subject to carry out the detection of irregular feeding in accordance with the (value) of transparent light detected at least two different detecting places in the direction of feeding for the printing papers. The detection is carried out by utilizing the time when the printing paper reaches to the starting position as a reference.

ADVANTAGES OF THE PRESENT INVENTION

An irregular feeding detection device for printing machine in the present invention, the starting position detector detects arrival of the printing paper at the starting position. On the other hand, the amount of transparent light at least two different detecting places determined by the starting position is detected by the transparent light amount detector.

Further, the reference light amount storing part stores the amount of transparent light detected at the different detecting places of a piece of the printing paper as a reference light amount for each of the different detecting places. Also, the judging part outputs the irregular feeding detection signal when the amount of transparent light detected at each of the detecting places being less than the reference light amount of corresponding detecting places by comparing the amount of transparent light detected at each of detecting places for the fed printing paper with each of the reference light amount.

Thus, it is possible for the transparent light amount detector to output the irregular feeding detection signal by judging irregularity of feeding even when the fed printing papers are overlapped at least two pieces and slipped each other. Because the transparent light amount detector carries out detection of irregularity at least two different detecting places in the direction of feeding. As a result, it is possible to provide an irregular feeding detection device with high detection precision.

Also, the transparent light amount detector carries out detection for irregularity of feeding at each of the detecting places by utilizing the time when the starting position detector detects the starting position as a reference. In other words, detection of irregularity can be carried out based on the condition when the printing paper reaches to the starting position. So that, it is possible to prevent erroneous detection caused by poor registration of the printing paper at the time of carrying out the detection. Therefore, it is possible to provide an irregular feeding detection device which prevents poor registration of the printing paper with high detection precision.

Further, judgement for irregularity of feeding is carried out by comparing a reference light value detected when a piece of the paper being fed, with the value of transparent light at each of the detecting positions of the fed printing paper. In other words, it is possible to execute a comparison of these value at each of the detecting places accurately.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An irregular feeding detection device for printing machine for detecting irregular feeding of printing papers fed at least two pieces under overlapped condition in basis of amount of transparent light which is emitted from a light source and through a printing paper fed to the printing machine comprising:

a starting position detector for detecting arrival of the printing paper at a starting position, a transparent light amount detector for detecting the amount of transparent light of the printing paper detected at least two different detecting places, the different detecting places are determined by the starting position, and wherein the different detecting places are radiated by the light from the light source, a reference light amount storing part for storing the amount of transparent light detected at the different detecting places of a piece of the printing paper as a reference light amount for each of the different detecting places, and a judging part for outputting irregular feeding detection signal when the amount of transparent light detected at each of the detecting places being less than the reference light amount of corresponding detecting places.

2. An irregular feeding detection device in accordance with claim 1 wherein, said transparent light amount detector comprises a plurality of detectors, and said starting position detector is provided separately from the detectors.

3. An irregular feeding detection device in accordance with claim 1 wherein, said transparent light amount detector comprises a plurality of detectors, and one of the detectors is also utilized as said starting position detector.

4. An irregular feeding detection device in accordance with claim 1 wherein, said transparent light amount detector comprises a singular of detector, and said starting position detector is provided separately from the detector.

5. An irregular feeding detection device in accordance with claim 4 wherein, said singular of transparent light amount detector carries out detection for the amount of transparent light at least two different detecting places in plural times with predetermined intervals, and wherein a timing detector is provided for outputting timing signal by detecting rotation timing of a printing drum which the printing papers are supplied thereto, and wherein the intervals are measured in accordance with the timing signal outputted by the timing detector.

6. An irregular feeding detection device in accordance with claim 4 wherein, said singular of transparent light amount detector carries out detection for the amount of transparent light at least two different detecting places in plural times with predetermined intervals, and wherein a line sensor which includes a plurality of detecting elements arranged in a series toward a direction of feeding for the printing paper is provided, and wherein the intervals are measured in accordance with detections of foremost part of the printing paper by at least two of the detecting elements specified in the line sensor.

7. An irregular feeding detection device in accordance with claim 1 wherein, said transparent light amount detector comprises a singular of detector, and the singular detector is further utilized as said starting position detector.

8. An irregular feeding detection device in accordance with claim 7 wherein, said singular of transparent light amount detector carries out detection for the amount of transparent light at least two different detecting places in plural times with predetermined intervals, and wherein a timing detector is provided for outputting timing signal by detecting rotation timing of a printing drum which the printing papers are supplied thereto, and wherein the intervals are measured in accordance with the timing signal outputted by the timing detector.

9. An irregular feeding detection device in accordance with claim 7 wherein, said singular of transparent light amount detector carries out detection for the amount of transparent light at least two different detecting places in plural times with predetermined intervals, and wherein a line sensor which includes a plurality of detecting elements arranged in a series is provided toward a direction of feeding for the printing paper, and wherein the intervals are measured in accordance with detections of foremost part of the printing paper by at least two of the detecting elements specified in the line sensor.

10. An irregular feeding detection device in accordance with claim 1 wherein, said irregular feeding detection signal is outputted by said judging part only when the amount of transparent light detected at least two detecting places is less than said reference light amount.

11. A detection method of irregular feeding for printing machine for detecting irregular feeding of printing papers fed at least two pieces under overlapped condition in basis of amount of transparent light which is emitted from a light source and through a printing paper fed to the printing machine comprising steps of:

step for storing the amount of transparent light detected at least two different detecting places of a piece of the printing paper as a reference light amount for each of the different detecting places, step for detecting arrival of the printing paper at a staring position, step for determining the different detecting places of the printing paper by the starting position, step for radiating the light from the light source to the different detection places of the printing paper, step for detecting the amount of transparent light at the different detecting places of the printing paper, step for outputting irregular feeding detecting signal when the amount of transparent light detected at each of the different detecting places being less than the reference light amount of corresponding detecting places.

* * * * *